US009306278B2

(12) United States Patent
Lever et al.

(10) Patent No.: US 9,306,278 B2
(45) Date of Patent: Apr. 5, 2016

(54) COMMON MULTI-PURPOSE ACTUATOR TO CONTROL ANTENNA REMOTE ELECTRICAL TILT, REMOTE AZIMUTH STEERING AND REMOTE AZIMUTH BEAM-WIDTH CONTROL

(71) Applicant: Intel Corporation, Santa Clara, CA (US)

(72) Inventors: Sean Lever, Irvine, CA (US); Nando Hunt, Newport Beach, CA (US); Ching-Shun Yang, Irvine, CA (US); George Sideris, Irvine, CA (US); Carmine M. Fiorello, San Juan Capistrano, CA (US); Alexander Rabinovich, Cypress, CA (US)

(73) Assignee: Intel Corporation, Santa Clara, CA (US)

( * ) Notice: Subject to any disclaimer, the term of this patent is extended or adjusted under 35 U.S.C. 154(b) by 558 days.

(21) Appl. No.: 13/675,906

(22) Filed: Nov. 13, 2012

(65) Prior Publication Data

US 2013/0120202 A1 May 16, 2013

Related U.S. Application Data

(60) Provisional application No. 61/559,496, filed on Nov. 14, 2011.

(51) Int. Cl.

| | |
|---|---|
| ***H01Q 3/00*** | (2006.01) |
| ***H01Q 3/04*** | (2006.01) |
| *H01Q 1/24* | (2006.01) |

(52) U.S. Cl.
CPC . *H01Q 3/04* (2013.01); *H01Q 1/246* (2013.01)

(58) Field of Classification Search
CPC ..... H01Q 3/04; H01Q 3/08; H01Q 3/005
USPC ..... 343/757, 766, 763
See application file for complete search history.

(56) References Cited

U.S. PATENT DOCUMENTS

| | | | | |
|---|---|---|---|---|
| 2003/0052630 | A1* | 3/2003 | Enzinna et al. | 318/280 |
| 2004/0012532 | A1* | 1/2004 | Rose et al. | 343/725 |
| 2005/0046514 | A1* | 3/2005 | Janoschka | 333/156 |
| 2007/0008230 | A1* | 1/2007 | Osaka et al. | 343/702 |
| 2007/0241979 | A1* | 10/2007 | Yang | 343/765 |
| 2008/0316133 | A1* | 12/2008 | Guixa Arderiu | 343/766 |
| 2009/0135074 | A1* | 5/2009 | Yang et al. | 343/766 |
| 2010/0045555 | A1* | 2/2010 | Ryou et al. | 343/757 |

* cited by examiner

*Primary Examiner* — Dameon E Levi
*Assistant Examiner* — Collin Dawkins
(74) *Attorney, Agent, or Firm* — Schwegman Lundberg & Woessner, P.A.

(57) ABSTRACT

A common multi-purpose actuator to control antenna remote electrical tilt, remote azimuth steering, and remote azimuth beam-width control is disclosed. A single stepper motor uses a Hall-sensor for closed loop positioning feedback. Serial and parallel communications are employed through the same harness to the motor control circuit. The driven shaft of the motor turns a self-locking worm-gear which rotates a mating shaft which drives the necessary gearing. The actuator assembly can be arranged in multiple or single output configurations. DC line filtering improves the antenna signal to spurious noise ratio.

17 Claims, 16 Drawing Sheets

COMMON MULTI-PURPOSE ACTUATOR TO CONTROL ANTENNA REMOTE ELECTRICAL TILT, REMOTE AZIMUTH STEERING AND REMOTE AZIMUTH BEAM-WIDTH CONTROL

RELATED APPLICATION INFORMATION

The present application claims priority under 35 U.S.C. Section 119(e) to U.S. Provisional Patent Application Ser. No. 61/559,496 filed Nov. 14, 2011, the disclosure of which is incorporated herein by reference in its entirety.

BACKGROUND OF THE INVENTION

1. Field of the Invention

The present invention relates in general to communication systems and components. More particularly, the present invention is directed to antennas for wireless networks.

2. Description of the Prior Art and Related Background Information

Base station antennas require low power consumption and high interoperability compatibility. Antennas must pass and transmit signals with minimum distortion and loss. Until recently, antennas have been passive devices, with their radiation pattern steering controlled by means of static mechanical mounts. With advances in computer networking, dynamic remote electro-mechanical control of antennas is possible. Antenna systems may be single or multi-band with at least one of the following radiation pattern parameters controlled remotely: Vertical Beam-peak Steering ("RET"—Remote electrical tilt), Azimuth Beam-peak Steering ("RAS"—Remote azimuth steering), and Azimuth Beam-peak Width ("RAB"—Remote azimuth beam-width). Such RET 110, RAS 120 and RAB 130 control are illustrated in FIG. 1 where 102 represents an antenna and 104 represents exemplary radiation emission patterns.

Systems employing RET, RAS, and RAB can already be met by existing designs, but designers struggle with hardware designs that can be flexible enough to meet industry requirements such as the AISG ("Antenna Interface Standards Group") v1 and AISGv2 tower mounted specifications, while meeting competitive cost targets. Antennas are measured competitively for signal to noise ratio and the space they occupy on the tower (i.e., their foot-print). A smaller antenna with the same performance is much more desirable than a larger antenna due to vibration and wind loading and the limited space available. Additionally, cost competitiveness and supply chain flexibility create the demand for common re-usable parts and sub-assemblies.

Accordingly, there is a need to provide a simpler remote controlled system and method to adjust the radiation emission pattern of antennas.

SUMMARY OF THE INVENTION

In a first aspect, the present invention provides a remote controlled actuator system for adjusting a radiation emission pattern of an antenna. The system comprises a master controller providing actuator control signals for controlling antenna radiation emission patterns and two or more actuators, each actuator comprising an actuator control circuit communicating with the master controller and receiving actuator control signals, the actuator control circuit receiving actuator feedback signals including rotational position feedback signals and providing a drive signal in response to the actuator control signals and the actuator feedback signal.

Each actuator further comprises a motor having a drive shaft, the motor receiving the drive signal and rotating the drive shaft based on the drive signal, a rotation sensor coupled to the drive shaft, the rotation sensor detecting a rotational position of the drive shaft and providing the rotational position feedback signals to the actuator control circuit, and an actuator gear coupled to the drive shaft. The system further comprises a mechanical coupling assembly having a mechanical input coupled to the actuator gear of at least one of the two or more actuators and a mechanical output coupled to a movable portion of an antenna, the assembly adjusting the radiation emission pattern of the antenna in response to rotation of the actuator gear of at least one of the two or more actuators.

In an embodiment, the mechanical coupling assembly may provide more than one mechanical output. The mechanical coupling assembly preferably further comprises one or more mechanical stops which limit the range of motion of the mechanical output. The remote controlled actuator system preferably further comprises a data bus connecting the actuator control circuits of the two or more actuators and the master controller, wherein the actuator control circuits and the master controller are connected in series in one embodiment. Alternatively, the actuator control circuit and the master controller are connected in parallel. Each of the actuator control circuit further preferably comprises one or more line filters for suppressing signal noise intermodulation distortion between the antenna and the actuator control circuit. Each of the actuator control circuits preferably changes operation status between an active mode and a dormant mode based on activity on a data bus connecting the actuator control circuit and the master controller. Each of the actuator control circuits preferably communicates with the master controller via a single wire interface. The mechanical coupling assembly preferably further comprises one or more coupling gears in meshing engagement and positioned perpendicular with the actuator gear of at least one of the two or more actuators, and one or more toothed racks in meshing engagement with a corresponding coupling gear, the one or more toothed racks translating in response to the rotation of the actuator gear of at least one of the two or more actuators.

The mechanical coupling assembly preferably further comprises a bracket mount plate having a shaft pin extending perpendicular from the bracket mount plate, the bracket mount plate having a curved toothed rack and forming an arc on the surface of the bracket mount plate, the curved toothed rack having a center corresponding with the center of the shaft pin, and an actuator mounting plate positioned apart and away from the bracket mount plate. The actuator mounting plate has a hole receiving the shaft pin, the actuator mounting plate pivotally coupled to the shaft pin, the actuator mounting plate securing one actuator of the two or more actuators and positioning the actuator gear of the actuator in meshing engagement with the curved toothed rack, the actuator gear of the actuator urging the actuator mounting plate to pivot about the shaft pin in response to rotation of the actuator gear.

The mechanical coupling assembly may further comprise a bracket mount plate having a shaft pin extending perpendicular from the bracket mount plate, a first plate having a first hole receiving the shaft pin and pivotally coupling the shaft pin, the first plate having a first curved slot shaped as an arc having a center corresponding with the first hole, the first curved slot having a first toothed portion along a length of the first curved slot, a second plate placed adjacent to the first plate, the second plate having a second hole receiving the shaft pin and pivotally coupling the shaft pin, the second plate having a second curved slot shaped as an arc having a center corresponding with the second hole, the second curved slot having a second toothed portion along a length of the second curved slot. One actuator of the two or more actuators is preferably coupled to the bracket mount plate and positions the actuator gear of the actuator in meshing engagement with the first and second toothed portions of the first and second plates, the actuator gear of the second actuator urging the first and second plates to pivot in opposite directions in response to rotation of the actuator gear of the actuator.

In another aspect, the present invention provides a remote controlled antenna system having an adjustable radiation emission pattern, the system comprising an antenna having first and second movable portions. The system further comprises a first actuator having a first actuator gear coupled to a first drive shaft, a bracket mount plate having a shaft pin extending perpendicular from the bracket mount plate, the bracket mount plate having a curved toothed rack and forming an arc on the surface of the bracket mount plate, the curved toothed rack having a center corresponding with the shaft pin, and an actuator mounting plate positioned apart and away from the bracket mount plate. The actuator mounting plate has an actuator mounting plate hole receiving the shaft pin, the actuator mounting pivotally coupling the shaft pin, the actuator mounting plate coupled to the first and second movable portions of the antenna, the actuator mounting plate securing the first actuator and positioning the first actuator gear in meshing engagement with the curved toothed rack, the first actuator gear urging the actuator mounting plate and the first and second movable portions of the antenna to pivot about the shaft pin in response to rotation of the first actuator gear.

In a preferred embodiment, the remote controlled antenna system preferably further comprises a second actuator having a second actuator gear coupled to a second drive shaft, the second actuator mounted on the actuator mounting plate, a first plate securing the first movable portion of the antenna and having a first hole receiving the shaft pin and pivotally coupling the shaft pin, the first plate having a first curved slot shaped as an arc having a center corresponding with the shaft pin, the first curved slot having a first toothed portion along a length of the first curved slot, a second plate placed adjacent to the first plate, the second plate securing the second movable portion of the antenna and having a second hole receiving the shaft pin and pivotally coupling the shaft pin, the second plate having a second curved slot shaped as an arc having a center corresponding with the shaft pin, the second curved slot having a second toothed portion along a length of the second curved slot. The second actuator gear is preferably positioned in meshing engagement with the first and second toothed portions of the first and second plates, the second actuator gear urging the first and second plates and the first and second portions of the antenna to pivot in opposite directions in response to rotation of the actuator gear. The system preferably further comprises a first set of radiating elements coupled to the first movable portion of the antenna, and a second set of radiating elements coupled to the second movable portion of the antenna. The first actuator preferably further comprises a first stepper motor having the first drive shaft, and a first rotation sensor coupled to the first drive shaft, the first rotation sensor detecting a rotational position of the first drive shaft and providing first rotational position feedback signals. The second actuator preferably further comprises a second stepper motor having the second drive shaft, and a second rotation sensor coupled to the second drive shaft, the second rotation sensor detecting a rotational position of the second drive shaft and providing second rotational position feedback signals.

In another aspect, the present invention provides a method of adjusting a radiation emission pattern of an antenna system comprising plural actuators each actuator having a drive shaft, and a mechanical coupling assembly having a mechanical output. The method comprises providing actuator control signals to plural actuators employing a common control signal format, rotating a drive shaft of at least one actuator of the plural actuators in response to the actuator control signals, detecting a rotational position of the drive shaft and providing rotational position feedback signals, coupling to the drive shaft, providing a mechanical output to an antenna, and adjusting the radiation emission pattern of the antenna.

In a preferred embodiment, providing a mechanical output may comprise transforming the rotational motion of the drive shaft of at least one actuator to a translational motion of a phase shifting means for varying the phase of an antenna element. Providing a mechanical output may comprise transforming the rotational motion of the drive shaft of at least one actuator to a pivoting motion of an antenna. Providing a mechanical output may comprise transforming the rotational motion of the drive shaft of at least one actuator to a pivoting motion of first and second subsets of radiating elements, wherein the pivoting motion of the first subsection is opposite that of the second subsection, to provide variable beam-width of the radiation pattern of the radiating elements. The method preferably further comprises detecting a mechanical stop in the mechanical coupler.

Further features and aspects of the invention are set out in the following detailed description.

DETAILED DESCRIPTION OF THE INVENTION

A single common actuator for systems employing RET, RAS and RAB is disclosed. RET, RAS, and RAB control utilizing the disclosed actuator may employ the teachings of U.S. Pat. No. 7,505,010 entitled "ANTENNA CONTROL SYSTEM" and U.S. Pat. No. 7,990,329 entitled "DUAL STAGGERED VERTICALLY POLARIZED VARIABLE AZIMUTH BEAM-WIDTH ANTENNA FOR WIRELESS NETWORK," the disclosures of which are incorporated herein by reference in their entirety. Remote electrical tilt is varied when the actuator slides the phase shifter dielectrics as disclosed in U.S. Pat. No. 7,505,010 for example. Remote azimuth steering is varied when the actuator rotates the antenna center around its base as disclosed in U.S. Pat. No. 7,990,329 for example. Remote azimuth beam-width is varied when the actuator opens and closes the scissor assembly as disclosed in U.S. Pat. No. 7,990,329 for example. It shall be understood, however, that the examples illustrated in the disclosures of these patents as well as exemplary embodiments described below are non-limiting and other mechanisms for adjusting the radiation emission pattern of an antenna are contemplated in one or more embodiments.

The common purpose actuator in one or more embodiments will preferably use a stepper motor, a Hall sensor, and control circuitry protection to drive advanced antenna functions uniquely. The actuator has been designed to provide single or multiple mechanical outputs, a motor range of motion defined by the use of mechanical end stops, a flexible network design, DC line filtering of internal active electronic components to improve the antenna signal to spurious noise ratio, minimized current consumption in the actuator system, and a single wire interface used for the communication between the AISG controller and the individual actuators in the system.

Figure 1:
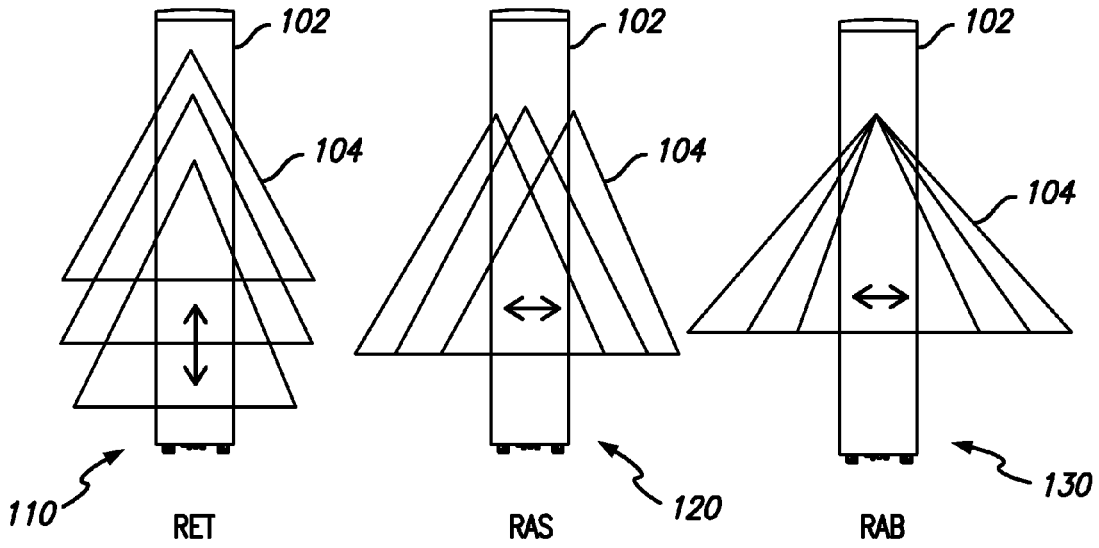
FIG. 1 is a block schematic diagram of radiation emission patterns illustrating beam tilt, beam steering, and beam-width control.
Figure 2:
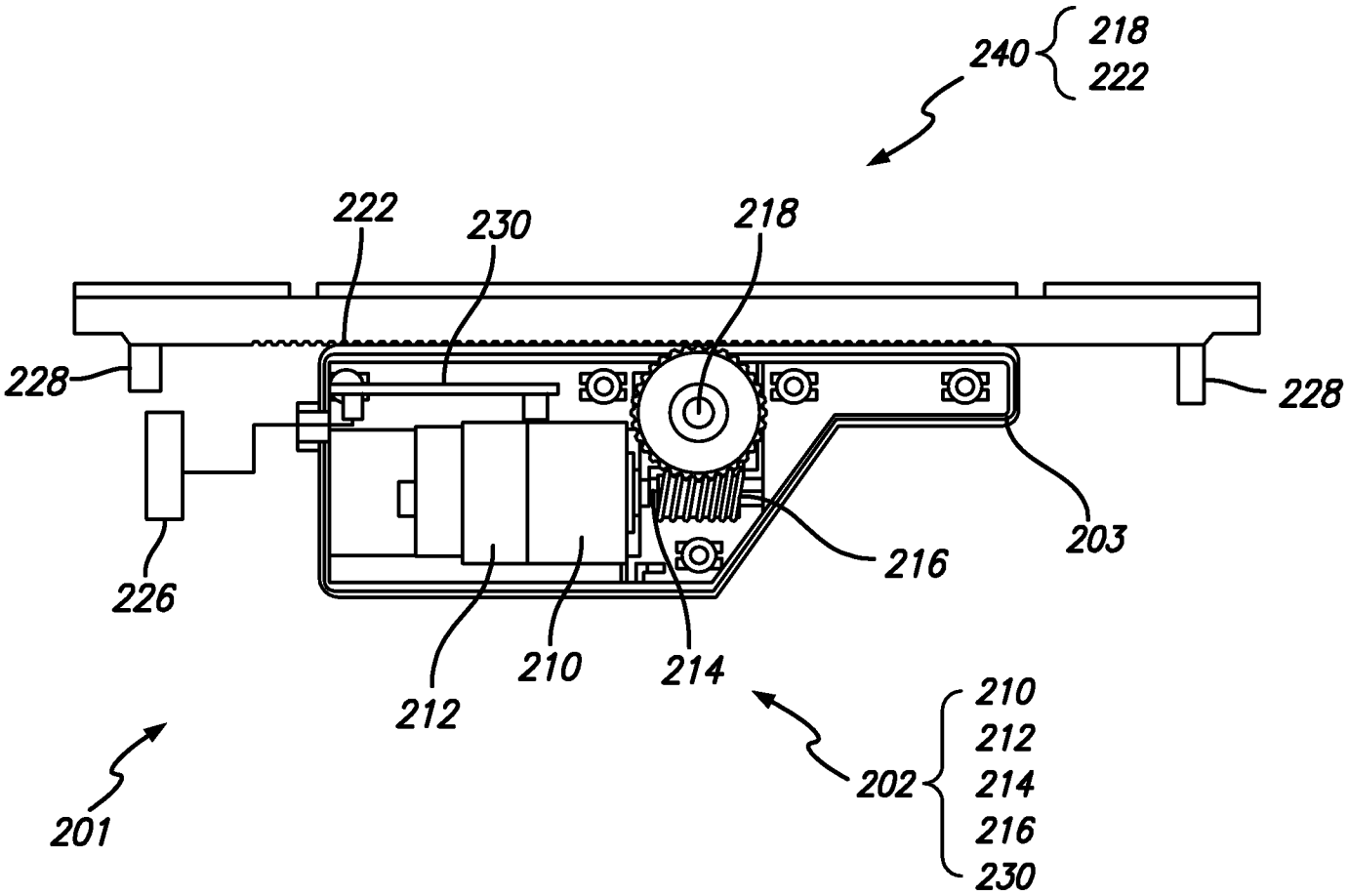
FIG. 2 is a side view of an actuator in a system which provides translational motion to an upper plate in an embodiment.
Figure 3:
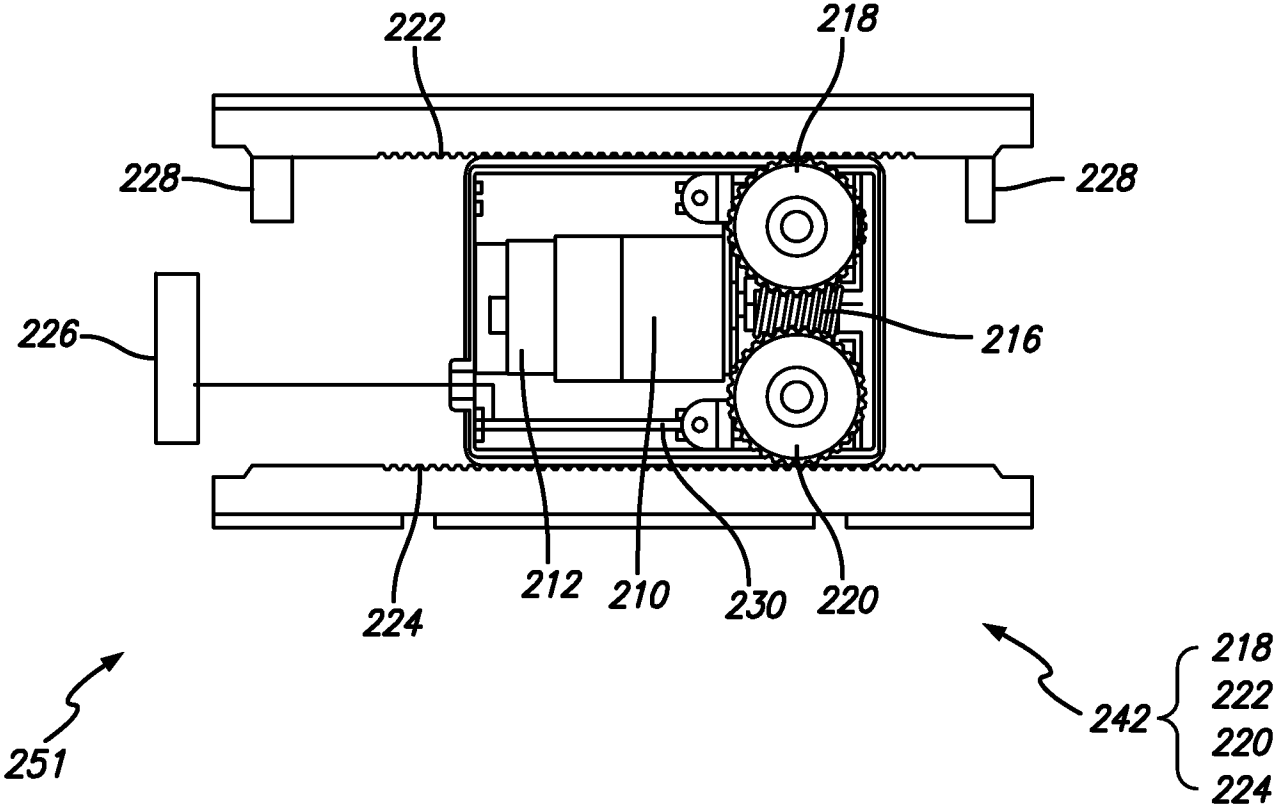
FIG. 3 is a side view of an actuator in a system which provides translation motion to the upper and lower plates in an embodiment.

Embodiments of the actuator may have single or multiple mechanical outputs as illustrated in FIG. 2 (illustrating a single output actuator system 201) and FIG. 3 (illustrating a multiple output actuator system 251). A stepper motor 210 may preferably drive an actuator gear 216 such as a worm gear with matching coupling gears 218 such as one or more pinion gear(s). The coupling gear 218 such as a pinion gear drives a toothed rack 222 or matching gear located outside of the actuator assembly. Electrical connections will preferably be via multi-pin connection headers 226. These outputs are used to drive single or multiple RET/RAB/RAS devices. The gear ratios between the first coupling gear 218 and the second coupling gear 220 may be varied to produce different actuation characteristics where needed. The rotation direction of the first coupling gear 218 and the second coupling gear 220 may be varied with the addition of an additional gear (not shown). Positive position hold is achieved by using a self-locking worm gear. Powered motor resistance is not necessary.

Figure 4:
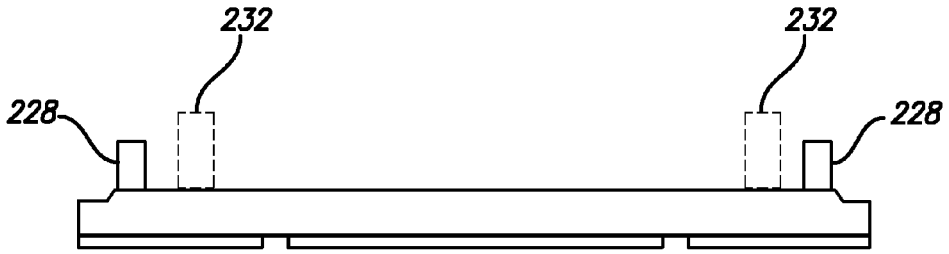
FIG. 4 is a representation of a system employing mechanical stops for limiting the range of motion.

The motor range of motion defined by the use of mechanical end stops 228 are illustrated in FIG. 4. Each motor controller or actuator control circuit 230 will use its rotation sensor 212 such as a Hall sensor to count the motor steps in-between start and stop positions 228 to determine its range of motion. The use of hard stops 228 protects the system from unsafe operation out of normal range. The hard stops create programmable reference positions to define the operational range of motion. Mechanical hard stop may have a buffered transition region such as soft stops 232 to provide for sensing of the oncoming end of travel. The controller may detect this by monitoring motor current or by monitoring the increase in duration between Hall sensor output pulses.

Figure 5:
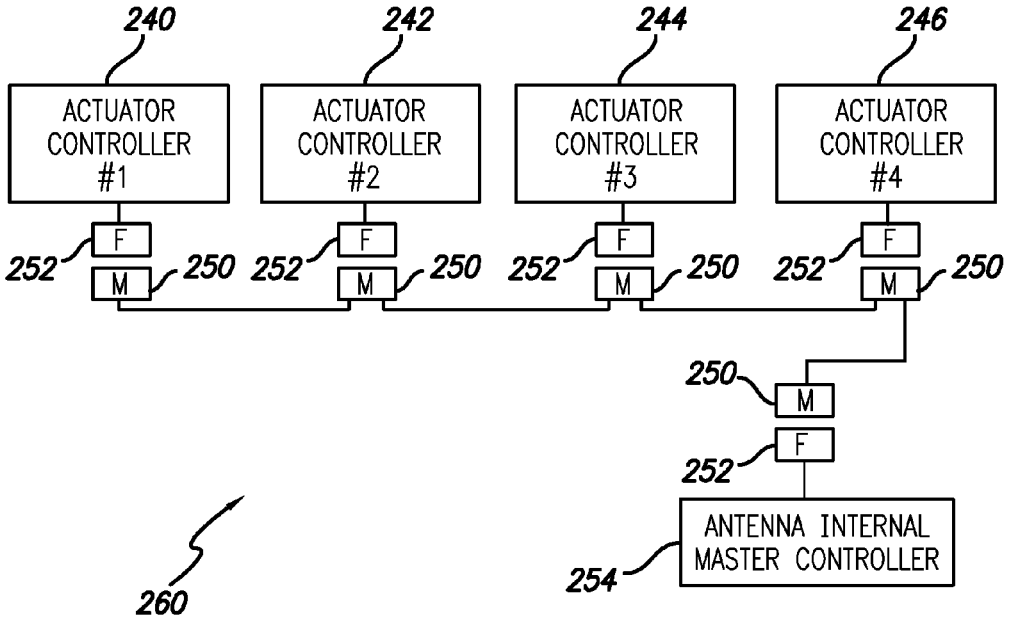
FIG. 5 is a schematic block diagram of a parallel network for a master controller and a plurality of actuator controllers.
Figure 6:
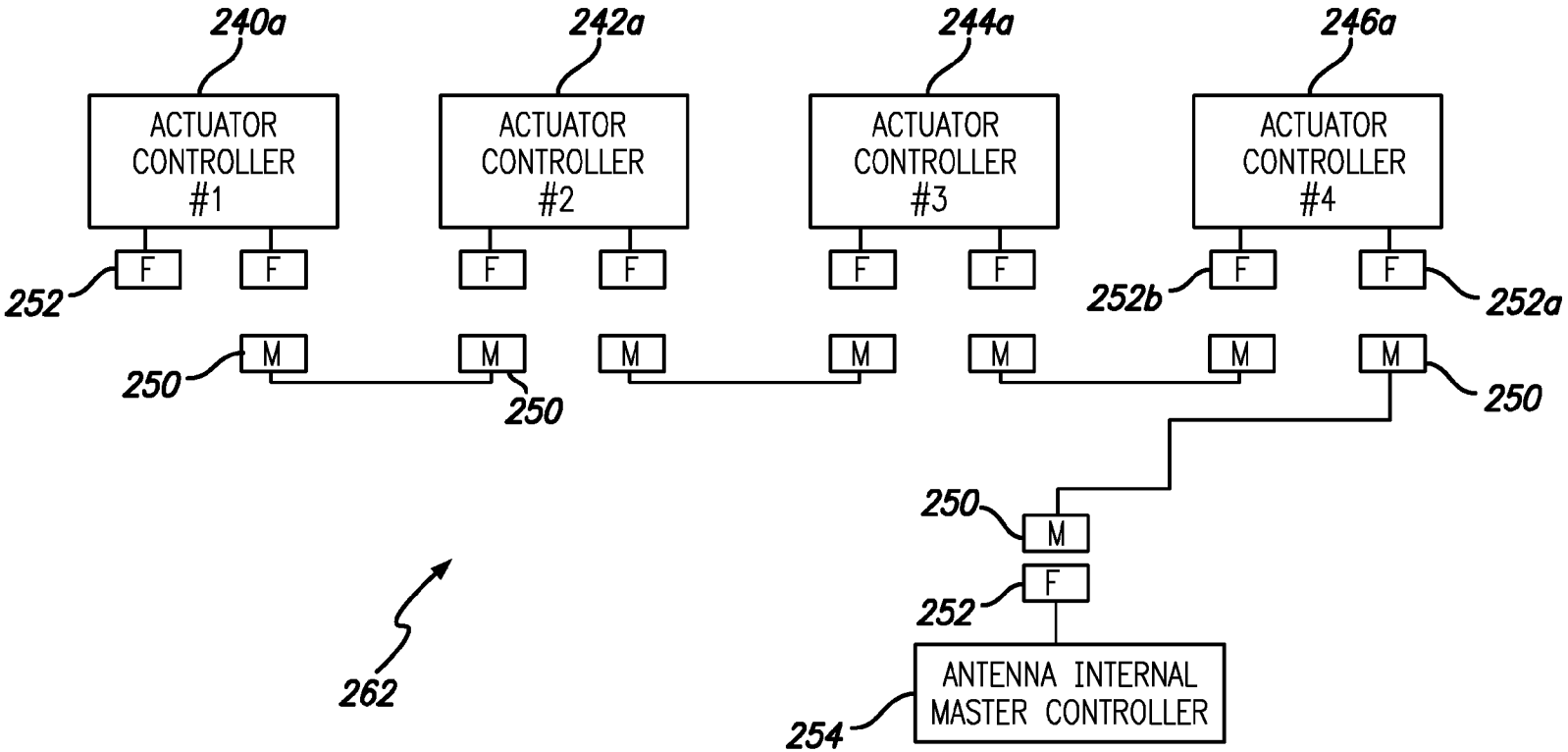
FIG. 6 is a schematic block diagram of a series network for the master controller and a plurality of actuator controllers.

One or more embodiments provide for flexible network design. This is illustrated in FIG. 5 (parallel network design 260) and FIG. 6 (series network design 262). Designs can be optimized for best power distribution, redundant protection, or lowest cost. Each actuator controller such as actuator controllers 240, 242, 244, and 246 will preferably have a single female output control cable 252. As depicted in FIG. 6, each actuator controller 240*a*, 242*a*, 244*a*, and 246*a* may have dual female output control cables 252 connecting to male control cables 250. Each antenna will preferably have an internal master controller 254 that will supervise the individual actuators. Network connections will preferably use multi-head cables for series and parallel wiring.

Figure 7:
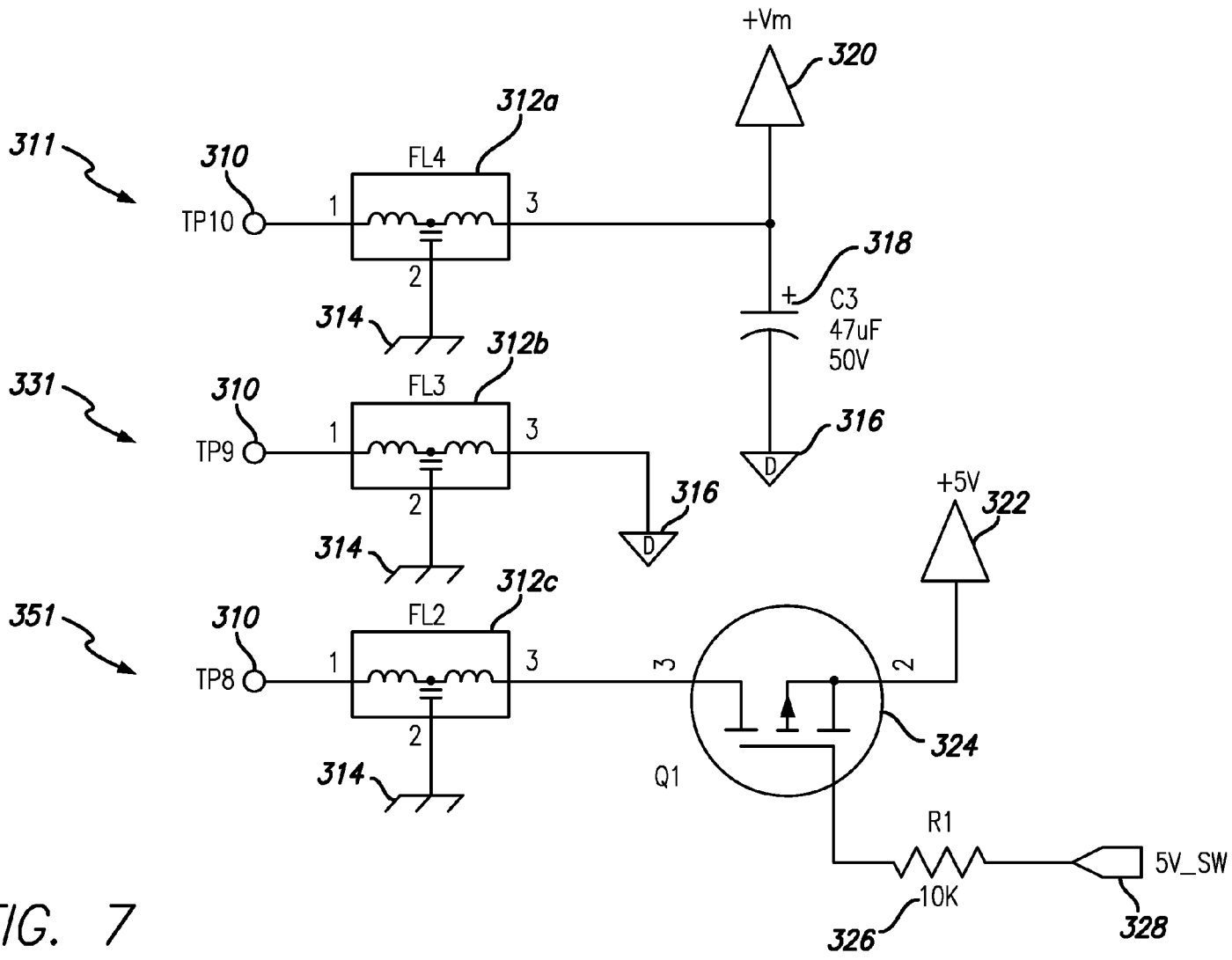
FIG. 7 depicts representations of actuator controller filter circuitry in one or more embodiments.

In one or more embodiments, DC line filtering of internal active electronic components may be employed to improve the antenna signal to spurious noise ratio. Exemplary circuits are illustrated in FIG. 7 (actuator controller filters). Controller wiring will preferably be grounded through line filters to suppress unwanted signal noise intermodulation distortion between the antenna near field and PCBA components. Solid core wiring is preferably used to minimize antenna signal to spurious noise ratio.

Three exemplary embodiments illustrating DC line filtering of internal active electronic components are shown in FIG. 7. In circuit 311, the test point 310 is connected to an inductor/capacitor network 312*a* having a bypass to ground 314. The output of network 312*a* is connected to voltage 320 and to bypass capacitor 318 connected to digital ground 316. In circuit 331, the test point 310 is connected to an inductor/capacitor network 312*b* having a bypass to ground 314. The output of network 312*a* is connected to digital ground 316. In circuit 351, the test point 310 is connected to an inductor/capacitor network 312*c* having a bypass to ground 314. The output of network 312*a* is connected to transistor 324, which is in turn connected to voltage 322 and to resistor 326 which is connected to voltage 328.

In one or more embodiments, current consumption is minimized in the actuator system. Actuator controllers such actuator control circuit 230 preferably self-determine periods of no activity and change their operational status from active to dormant. In dormant mode, current consumption is minimized and may be eliminated. The controller returns to active mode when activity is detected on the data bus. Minimized current consumption allows for larger systems within the power consumption limits of the AISG system specifications and antenna line device system design.

In one or more embodiments, single wire interface is used for the communication between the AISG controller and the individual actuators in the system. Fewer cables in the system minimize the spurious noise in the system.

As discussed above, one or more embodiments are directed to a single common actuator for RET, RAS, and RAB control. As shown in FIG. 2, an embodiment of a remote controlled actuator system 201 for adjusting the radiation emission pattern of an antenna comprises an actuator 202 which is coupled to a mechanical coupling assembly 240. The actuator 202 comprises an actuator control circuit 230, a stepper motor 210, a rotation sensor 212, a drive shaft 214, and an actuator gear 216 such a worm gear or a pinion. In one or more embodiments, the actuator may include an actuator housing 203 as well as more or less components as compared with the exemplary actuator 202. The actuator control circuit 230 communicates with a master controller 254 (as shown in FIGS. 5 and 6) and receives actuator control signals through connection header 226. The actuator control circuit 230 receives actuator feedback signals including rotational position feedback signals from the rotation sensor 212. The actuator control circuit 230 provides a pulsed current signal to the stepper motor 210 in response to the actuator control signals and the actuator feedback signal. The stepper motor 210 receives the pulsed current signal and rotates the drive shaft 214 based on the pulsed current signal. A rotation sensor 212 such as a Hall Sensor is coupled to the drive shaft 214 and detects the rotational position of the drive shaft 214 and provides rotational position feedback signals to the actuator control circuit 230. An actuator gear 216 is coupled to the drive shaft 214 and may be a worm gear or a pinion in one or more embodiments. A mechanical coupling assembly 240 is coupled to the actuator gear 216 and an antenna, such that the assembly provides a mechanical output to the antenna in response to rotation of the actuator gear 216 to adjust the radiation emission pattern of the antenna.

As depicted in FIG. 2, one or more embodiments of the mechanical coupling assembly 240 transforms the rotational motion of the actuator gear to a translational motion. In an embodiment, a single mechanical output mechanical assembly 240 shown in FIG. 2 comprises a coupling gear 218 and a toothed rack 222. The coupling gear 218 is in meshing engagement and is positioned perpendicular with the actuator gear 216. In an embodiment, the actuator gear 216 may be a worm gear and the coupling gear 216 may be a toothed gear. The toothed rack 222 is in meshing engagement with the coupling gear 218 such that the toothed rack 222 translates in response to the rotation of the actuator gear 216.

FIG. 3 depicts an alternate embodiment of a remote controlled actuator system 251 for adjusting the radiation emission pattern of an antenna comprises an actuator 202 which is coupled to a mechanical coupling assembly 242. The mechanical coupling assembly 242 provides two mechanical outputs and comprises coupling gears 218 and 220 and toothed racks 222 and 224. The coupling gears 218 and 228 are in meshing engagement and positioned perpendicular with the actuator gear 216. In an embodiment, the actuator gear 216 may be a worm gear and the coupling gear 216 may be a toothed gear. Toothed racks 222 and 224 are in meshing engagement with the coupling gears 218 and 220 such that the toothed racks 222 and 224 translate in response to the rotation of the actuator gear 216.

Figure 8:
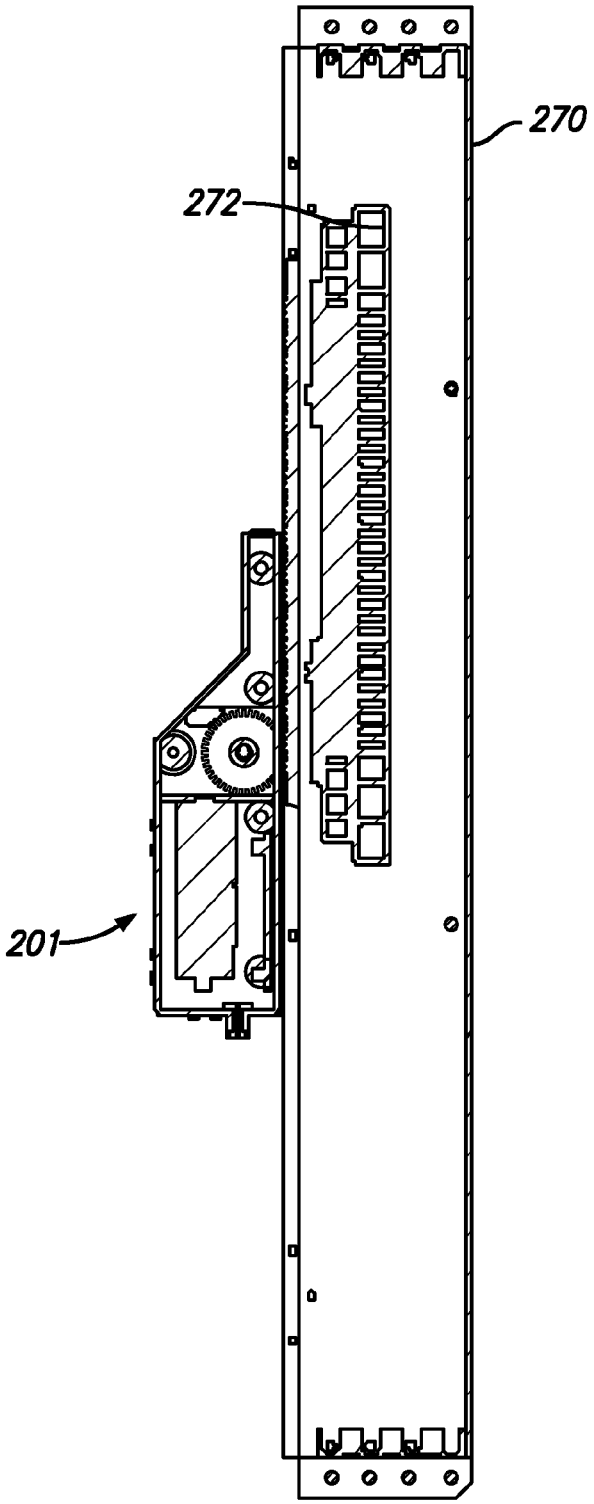
FIG. 8 is a side view of an actuator providing a phase shifting means for varying the phase of antenna elements of an antenna in an embodiment.

The toothed rack 222 may be coupled to an antenna such that the translational motion of the toothed rack adjusts the radiation emission pattern of an antenna. For example, as depicted in FIG. 8, actuator system 201 may be coupled to a sliding dielectric sheet 272 in an antenna 270. Other embodiments employing a phase shifting means for varying the phase of an antenna element may be found in U.S. Pat. No. 7,505,010 referenced above.

Figure 9:
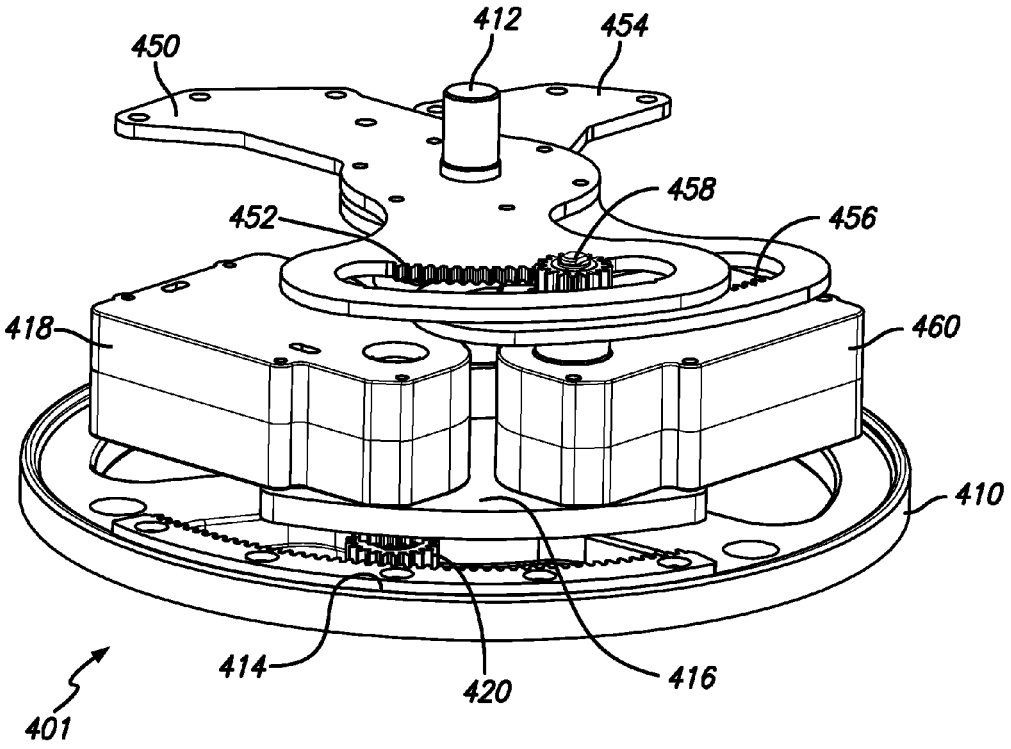
FIG. 9 is a perspective view of an assembly for adjusting beam steering and beam-width in an embodiment.
Figure 10:
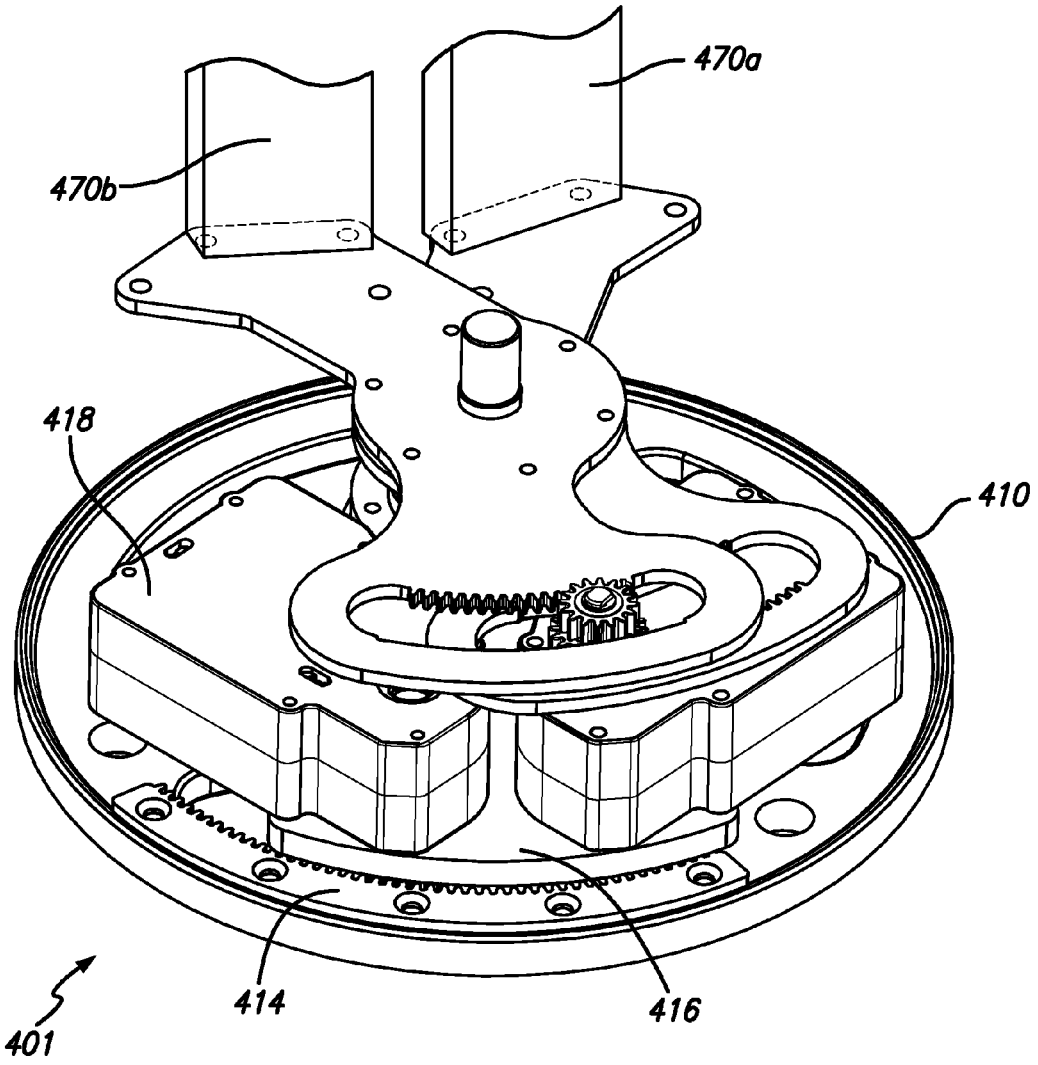
FIG. 10 is another perspective view of an assembly for adjusting beam steering and beam-width in an embodiment.

FIGS. 9 and 10 are perspective views of an exemplary assembly 401 for adjusting the beam steering and beam-width of an antenna employing actuators 418 and 460 each corresponding to FIG. 2 in a preferred embodiment. As a brief overview, the assembly 401 comprises a bracket mount plate 410 having a shaft pin 412 extending away from the bracket mount plate 410. The bracket mount plate 410 has a curved toothed rack 414 which forms an arc on the surface of the bracket mount plate 410. An actuator mount plate 416 positioned above the bracket mount plate 410 has a through hole which receives the shaft pin 412 enabling actuator mount plate 416 to pivot around shaft pin 412. Actuators 418 (for beam steering control) and 460 (for beam-width control) are mounted on actuator mount plate 416.

Beam steering control results from actuator 418 having an actuator gear 420 or pinion engaging with the curved tooth rack 414. When actuator 418 rotates the actuator gear 420, the actuator mount plate 416 pivots about the shaft pin 412 to steer the radiated emission pattern of an attached antenna.

Beam-width control results from two plates 450 and 454 each having a curved toothed slot 452 and 456 which engage with the actuator gear 458 from actuator 460. When actuator 460 rotates the actuator gear 458, the two plates 450 and 454 pivot in opposite directions about the shaft pin 412 to adjust the beam-width of the radiated emission pattern of an attached antenna.

Figure 11:
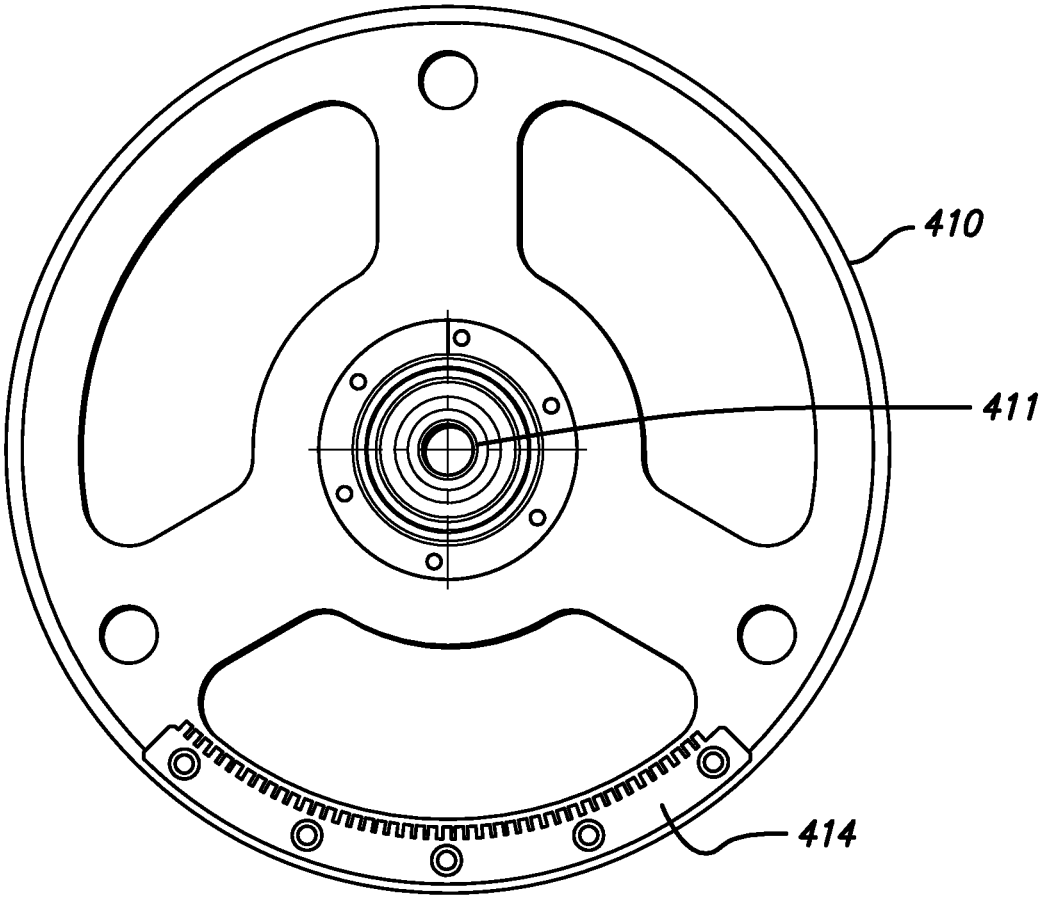
FIG. 11 is a top view of bracket mount plate of the assemblies illustrated in FIGS. 9 and 10.

More specifically with respect to the beam steering function, FIG. 11 illustrates a bracket mount plate 410 having center bushing or hole 411 for receiving the shaft pin 412 which extends perpendicular from the bracket mount plate 410. The bracket mount plate 410 has a curved toothed rack 414 which forms an arc on the surface of the bracket mount plate 410 and has a center corresponding to the center of the center bushing or hole 411 and the shaft pin 412.

Figure 12:
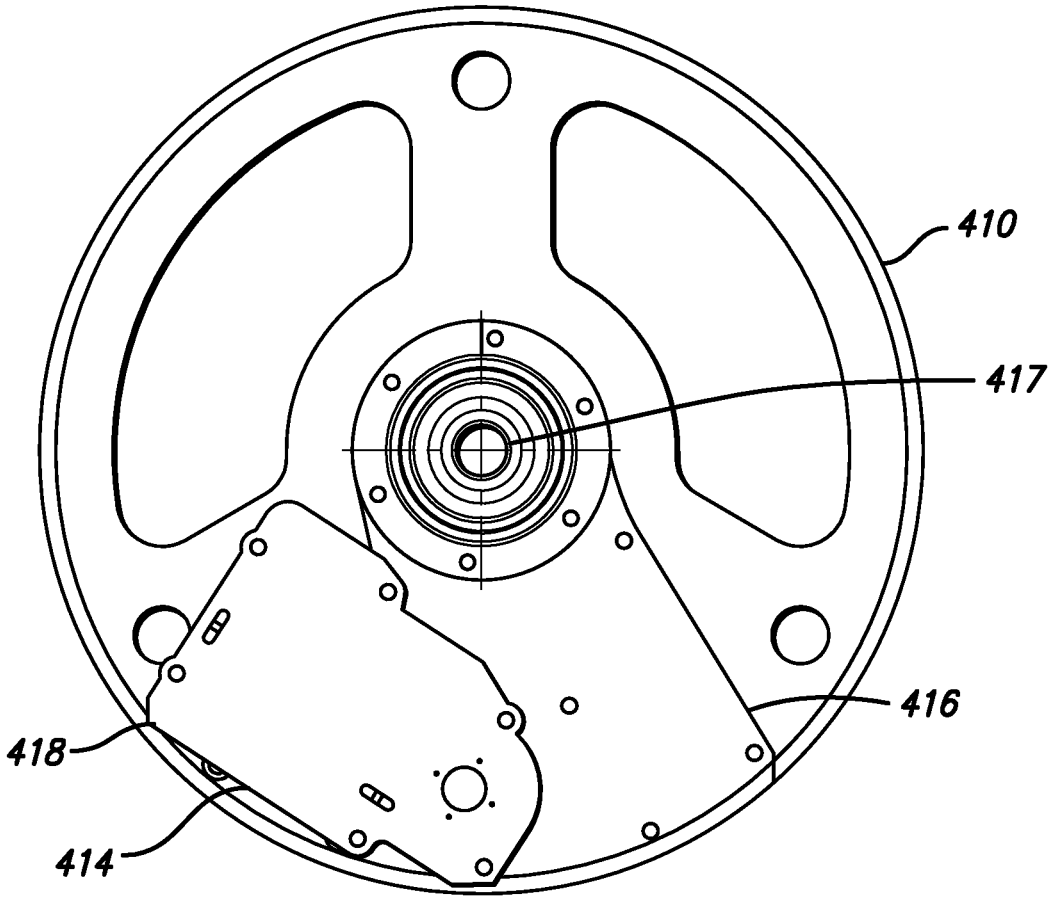
FIG. 12 is a top view of an actuator mount plate on the bracket mount plate.
Figure 13:
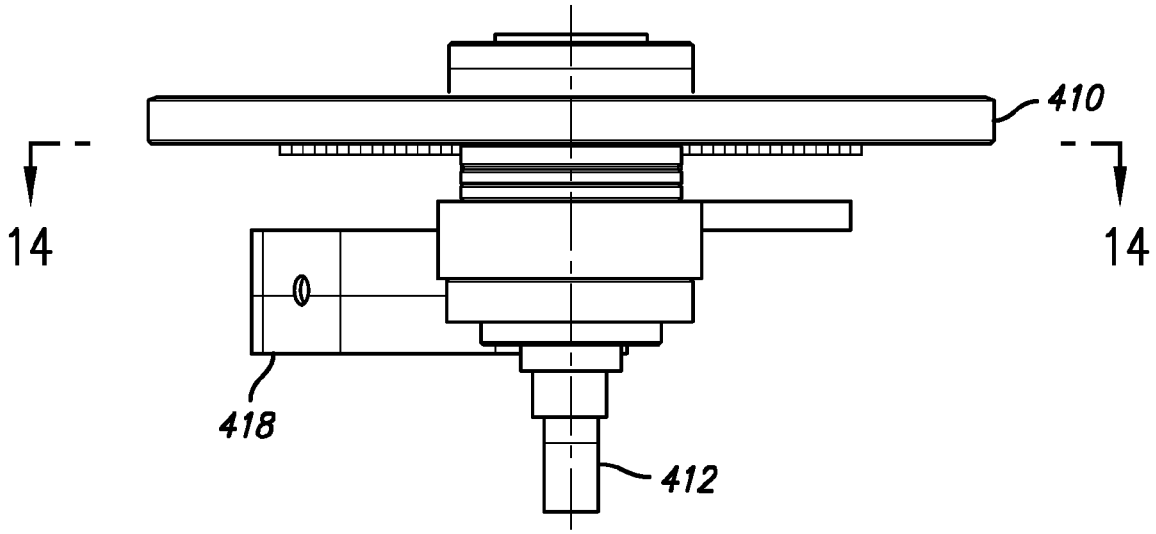
FIG. 13 is a side, cross-sectional view of the sub-assembly for adjusting beam steering.
Figure 14:
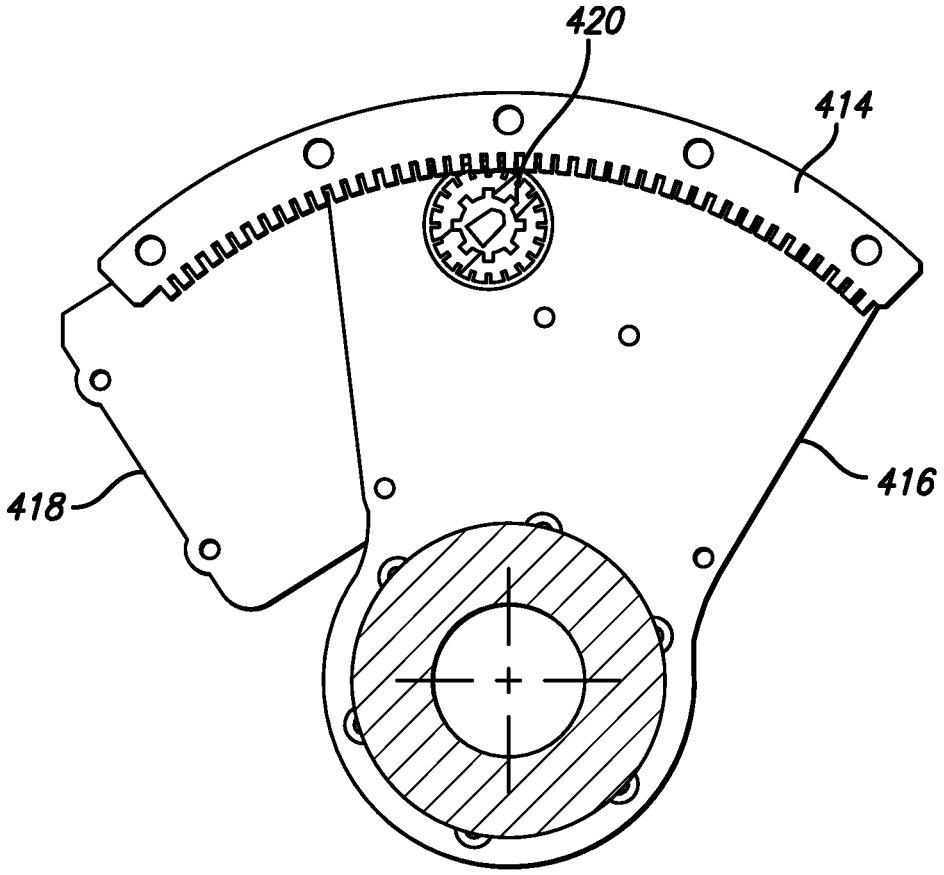
FIG. 14 is bottom view of the actuator mount plate showing the actuator gear in meshing engagement with a curved toothed rack.

FIGS. 9, 10, and 12 depict an actuator mounting plate 416 positioned apart and away from the bracket mount plate 410. The actuator mounting plate 416 has a center bushing or hole 417 receiving the shaft pin 412 such that the actuator mounting plate 416 is pivotally coupled to the shaft pin 412. The actuator mounting plate 416 secures the actuator 418 and positions the actuator gear 420 or pinion in meshing engagement with the curved toothed rack 414 as shown in FIGS. 13 and 14. The actuator gear 420 urges the actuator mounting plate 416 to pivot about the shaft pin 412 in response to rotation of the actuator gear 420. As depicted in FIG. 10, antenna sub-assemblies 470*a* and 470*b* are indirectly coupled to the actuator mounting plate 416 (discussed below) and therefore are partially rotated or steered as a result of the rotation of the actuator gear 420. The antenna sub-assemblies 470*a* and 470*b* may comprise one or more radiating elements.

Figure 15:
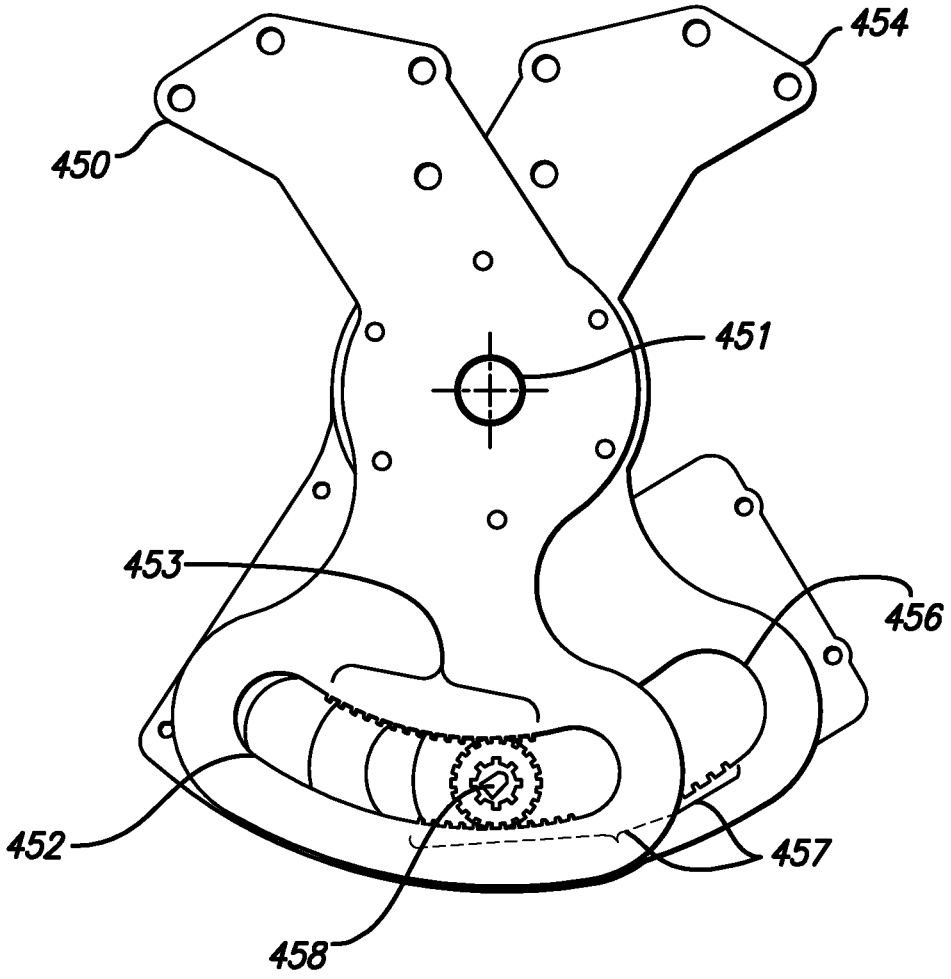
FIG. 15 is a top view of a first and second plates pivotally coupled to a shaft pin.
Figure 16:
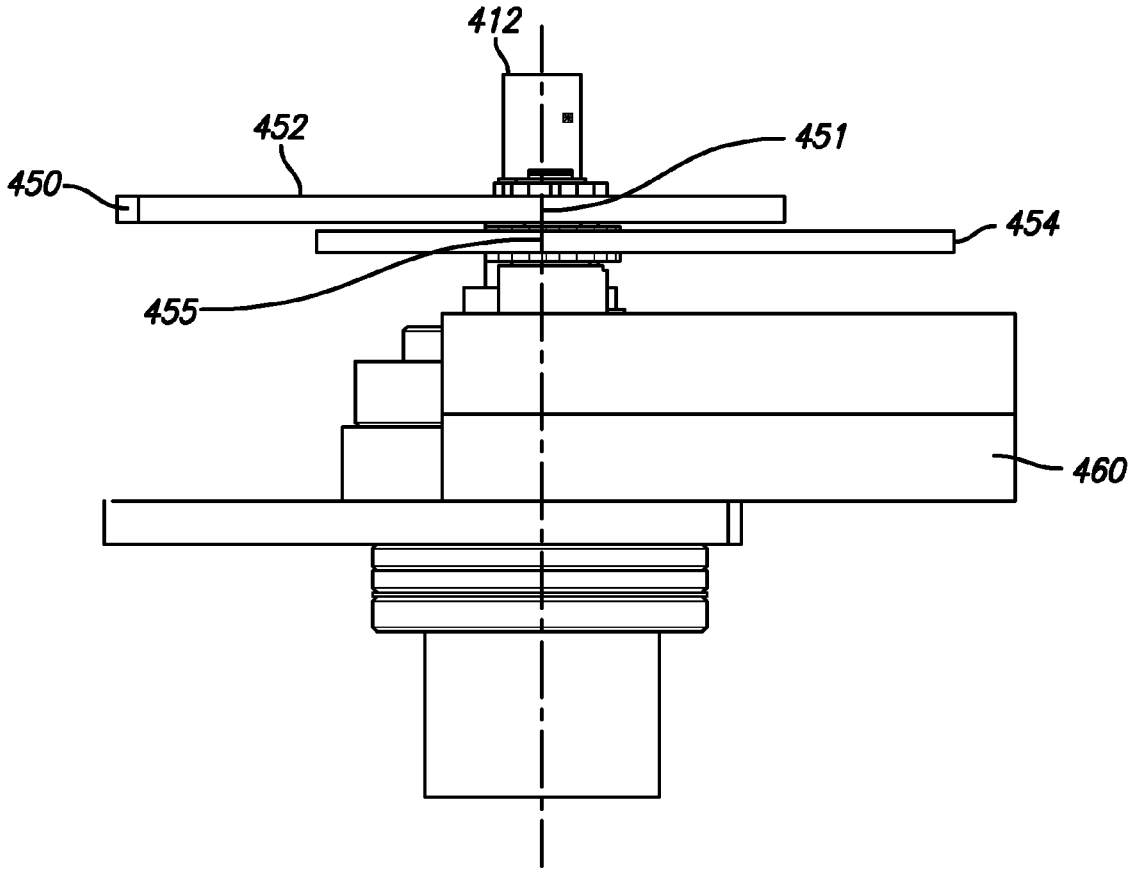
FIG. 16 is a side, cross-sectional view of the sub-assembly for adjusting beam-width.
Figure 17:
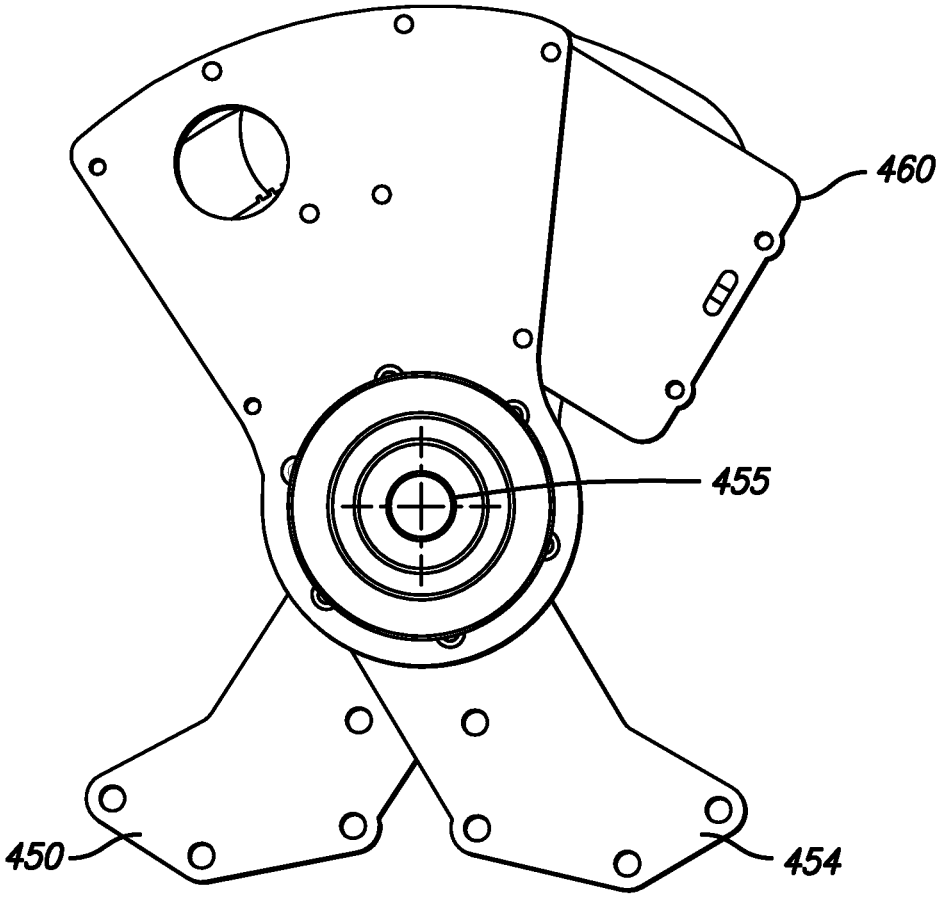
FIG. 17 is a bottom view of the first and second plates pivotally coupled to a shaft pin.

More specifically with respect to the beam-width control function, FIGS. 15-17 depict a first plate 454 having a first hole 455 which receives the shaft pin 412 and pivotally couples to the shaft pin 412. The first plate has a first curved slot 456 shaped as an arc having a center corresponding with the shaft pin and has a first toothed portion 457 along a length of the first curved slot 456. The first toothed portion 457 may be proximal or distal to the shaft pin 412.

A second plate 450 is placed adjacent to the first plate 454. The second plate 450 has a second hole 451 which receives the shaft pin 412 and pivotally couples to the shaft pin 412. The second plate 450 has a second curved slot 452 shaped as an arc having a center corresponding with the shaft pin 412. The second curved slot 452 has a second toothed portion 453 along a length of the second curved slot 452. The second toothed portion 453 may be proximal or distal to the shaft pin 412.

Actuator 460 is coupled to the actuator mount plate 416 and positions the actuator gear 458 in meshing engagement with the first and second toothed portions 457 and 453 of the first and second plates 454 and 450. The actuator gear 458 urges the first and second plates 454 and 450 to pivot in opposite directions in response to rotation of the actuator gear 458. In an embodiment and as depicted in FIG. 10, antenna sub-assemblies 470*a* and 470*b* are coupled to the first and second plates 450 and 454 and are individually pivoted in opposite directions thereby adjusting the beam-width of the radiated emission pattern.

The present invention has been described primarily as methods and structures for remote control of the radiation emission pattern antenna systems. Furthermore, the description is not intended to limit the invention to the form disclosed herein. Accordingly, variants and modifications consistent with the following teachings, skill, and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

What is claimed is:

1. A remote controlled actuator system for adjusting a radiation emission pattern of an antenna, comprising:

a master controller configured to provide actuator control signals to control antenna radiation emission patterns;

two or more actuators, each actuator comprising:

an actuator control circuit configured to communicate with the master controller and receive the actuator control signals, the actuator control circuit configured to receive actuator feedback signals including rotational position feedback signals, the actuator control circuit configured to provide a drive signal in response to the actuator control signals and the actuator feedback signals;

a motor having a drive shaft, the motor configured to receive the drive signal and rotate the drive shaft based on the drive signal;

a rotation sensor coupled to the drive shaft, the rotation sensor configured to detect rotational position of the drive shaft and configured to provide the rotational position feedback signals to the actuator control circuit; and an actuator gear coupled to the drive shaft; and a mechanical coupling assembly comprising:

a mechanical input coupled to the actuator gear of at least one of the two or more actuators and a mechanical output coupled to a movable portion of an antenna, the assembly configured to adjust the radiation emission pattern of the antenna in response to rotation of the actuator gear of said at least one of the two or more actuators, a bracket mount plate configured to comprise a shaft pin that extends perpendicular from the bracket mount plate, the bracket mount plate comprising a curved toothed rack and form an arc on the surface of the bracket mount plate, the curved toothed rack comprising a center that corresponds with the center of the shaft pin, and an actuator mounting plate positioned apart and away from the bracket mount plate, the actuator mounting plate comprising a hole that receives the shaft pin, the actuator mounting plate pivotally coupled to the shaft pin, the actuator mounting plate configured to secure one actuator of the two or more actuators and position the actuator gear of said actuator in meshing engagement with the curved toothed rack, the actuator gear of said actuator configured to urge the actuator mounting plate to pivot about the shaft pin in response to rotation of the actuator gear.

2. A remote controlled actuator system for adjusting a radiation emission pattern of an antenna as set out in claim 1, wherein the mechanical coupling assembly provides more than one mechanical output.

3. A remote controlled actuator system for adjusting a radiation emission pattern of an antenna as set out in claim 1, wherein the mechanical coupling assembly further comprises one or more mechanical stops which limit the range of motion of the mechanical output.

4. A remote controlled actuator system for adjusting a radiation emission pattern of an antenna as set out in claim 1, further comprises a data bus configured to connect the actuator control circuits of the two or more actuators and the master controller, wherein the actuator control circuits and the master controller are connected in series.

5. A remote controlled actuator system for adjusting a radiation emission pattern of an antenna as set out in claim 1, further comprises a data bus configured to connect the actuator control circuits of the two or more actuators and the master controller, wherein the actuator control circuit and the master controller are connected in parallel.

6. A remote controlled actuator system for adjusting a radiation emission pattern of an antenna as set out in claim 1, wherein each said actuator control circuit further comprises one or more line filters configured to suppress signal noise intermodulation distortion between the antenna and the actuator control circuit.

7. A remote controlled actuator system for adjusting a radiation emission pattern of an antenna as set out in claim 1, wherein each said actuator control circuit changes operation status between an active mode and a dormant mode based on activity on a data bus that connects the actuator control circuit and the master controller.

8. A remote controlled actuator system for adjusting a radiation emission pattern of an antenna as set out in claim 1, wherein each said actuator control circuit communicates with the master controller via a single wire interface.

9. A remote controlled actuator system for adjusting a radiation emission pattern of an antenna as set out in claim 1, wherein the mechanical coupling assembly further comprises:

one or more coupling gears in meshing engagement and positioned perpendicular with the actuator gear of at least one of the two or more actuators; and, one or more toothed racks in meshing engagement with a corresponding coupling gear, the one or more toothed racks configured to translate in response to the rotation of the actuator gear of said at least one of the two or more actuators.

10. A remote controlled actuator system for adjusting a radiation emission pattern of an antenna comprises:

a master controller configured to provide actuator control signals to control antenna radiation emission patterns;

two or more actuators, each actuator comprising:

an actuator control circuit configured to communicate with the master controller and receive the actuator control signals, the actuator control circuit configured to receive actuator feedback signals including rotational position feedback signals, the actuator control circuit configured to provide a drive signal in response to the actuator control signals and the actuator feedback signals;

a motor having a drive shaft, the motor configured to receive the drive signal and rotate the drive shaft based on the drive signal;

a rotation sensor coupled to the drive shaft, the rotation sensor configured to detect rotational position of the drive shaft and configured to provide the rotational position feedback signals to the actuator control circuit; and an actuator gear coupled to the drive shaft; and a mechanical coupling assembly comprising:

a mechanical input coupled to the actuator gear of at least one of the two or more actuators and a mechanical output coupled to a movable portion of an antenna, the assembly configured to adjust the radiation emission pattern of the antenna in response to rotation of the actuator gear of said at least one of the two or more actuators, a bracket mount plate comprising a shaft pin that extends perpendicular from the bracket mount plate;

a first plate comprising a first hole that receives the shaft pin and pivotally couples the shaft pin, the first plate comprising a first curved slot shaped as an arc that has a center corresponding with the first hole, the first curved slot comprising a first toothed portion along a length of the first curved slot; and, a second plate placed adjacent to the first plate, the second plate comprising a second hole that receives the shaft pin and pivotally couples the shaft pin, the second plate comprising a second curved slot shaped as an arc that has a center corresponding with the second hole, the second curved slot comprising a second toothed portion along a length of the second curved slot;

wherein one actuator of the two or more actuators is coupled to the bracket mount plate and positions the actuator gear of said actuator in meshing engagement with the first and second toothed portions of the first and second plates, the actuator gear of said actuator configured to urge the first and second plates to pivot in opposite directions in response to rotation of the actuator gear of said actuator.

11. A remote controlled antenna system having an adjustable radiation emission pattern, comprising:

an antenna comprising first and second movable portions;

a first actuator comprising a first actuator gear coupled to a first drive shaft;

a bracket mount plate comprising a shaft pin that extends perpendicular from the bracket mount plate, the bracket mount plate comprising a curved toothed rack that forms an arc on the surface of the bracket mount plate, the curved toothed rack comprising a center corresponding with the shaft pin; and an actuator mounting plate positioned apart and away from the bracket mount plate, the actuator mounting plate comprising an actuator mounting plate hole comprising the shaft pin, the actuator mounting plate pivotally coupled to the shaft pin, the actuator mounting plate coupled to the first and second movable portions of the antenna, the actuator mounting plate configured to secure the first actuator and positioning the first actuator gear in meshing engagement with the curved toothed rack, the first actuator gear configured to urge the actuator mounting plate and the first and second movable portions of the antenna to pivot about the shaft pin in response to rotation of the first actuator gear;

a second actuator configured to comprise a second actuator gear coupled to a second drive shaft, the second actuator mounted on the actuator mounting plate;

a first plate configured to secure the first movable portion of the antenna and configured to comprise a first hole receiving the shaft pin and pivotally coupling the shaft pin, the first plate configured to comprise a first curved slot shaped as an arc that has a center corresponding with the shaft pin, the first curved slot configured to comprise a first toothed portion along a length of the first curved slot; and a second plate placed adjacent to the first plate, the second plate configured to secure the second movable portion of the antenna and comprise a second hole that receives the shaft pin and pivotally couples the shaft pin, the second plate configured to receive a second curved slot shaped as an arc that has a center corresponding with the shaft pin, the second curved slot configured to comprise a second toothed portion along a length of the second curved slot, wherein the second actuator gear is positioned in meshing engagement with the first and second toothed portions of the first and second plates, the second actuator gear configured to urge the first and second plates and the first and second portions of the antenna to pivot in opposite directions in response to rotation of the actuator gear.

12. A remote controlled antenna system as set out in claim 11, further comprising:

a first set of radiating elements coupled to the first movable portion of the antenna; and a second set of radiating elements coupled to the second movable portion of the antenna.

13. A remote controlled antenna system as set out in claim 11, wherein the first actuator further comprises:

a first stepper motor having the first drive shaft; and, a first rotation sensor coupled to the first drive shaft, the first rotation sensor configured to detect a rotational position of the first drive shaft and provide first rotational position feedback signals; and, the second actuator further comprises:

a second stepper motor configured to comprise the second drive shaft; and, a second rotation sensor coupled to the second drive shaft, the second rotation sensor configured to detect a rotational position of the second drive shaft and provide second rotational position feedback signals.

14. A method of adjusting a radiation emission pattern of an antenna system comprising plural actuators each actuator having a drive shaft, and a mechanical coupling assembly having a mechanical output, comprising:

providing actuator control signals to the plural actuators employing a common control signal format;

rotating the drive shaft of at least one actuator of the plural actuators in response to the actuator control signals and rotational position feedback signals;

detecting a rotational position of the drive shaft and providing the rotational position feedback signals;

providing, via the drive shaft, a mechanical output to an antenna; and, adjusting the radiation emission pattern of the antenna, wherein providing a mechanical output comprises transforming rotational motion of the drive shaft of the at least one actuator to a pivoting motion of first and second subsets of radiating elements, wherein the pivoting motion of the first subset of radiating elements is opposite that of the second subset of radiating elements, to provide a variable beam-width of a radiation pattern of the radiating elements.

15. A method of adjusting a radiation emission pattern of an antenna system comprising plural actuators each actuator having a drive shaft, and a mechanical coupling assembly having a mechanical output as set out in claim 14, wherein providing a mechanical output comprises transforming the rotational motion of the drive shaft of the at least one actuator to a translational motion of a phase shifting means for varying a phase of an antenna element.

16. A method of adjusting a radiation emission pattern of an antenna system comprising plural actuators each actuator having a drive shaft, and a mechanical coupling assembly having a mechanical output as set out in claim 14, wherein providing a mechanical output comprises transforming the rotational motion of the drive shaft of the at least one actuator to a pivoting motion of the antenna.

17. A method of adjusting the radiation emission pattern of an antenna system comprising plural actuators each actuator having a drive shaft, and a mechanical coupling assembly having a mechanical output as set out in claim 14, further comprising detecting a mechanical stop in the mechanical coupling assembly.

* * * * *